US005263783A

United States Patent [19]

Wu

[11] Patent Number: 5,263,783

[45] Date of Patent: Nov. 23, 1993

[54] KEY SWITCH

[76] Inventor: Donald Wu, 4 F., No. 11, Alley 24, Lane 68, Sec. 1, Kuang-Fu Rd., San-Chung, Taipei, Taiwan

[21] Appl. No.: 5,392

[22] Filed: Jan. 15, 1993

[51] Int. Cl.[5] ..... B41J 5/12

[52] U.S. Cl. ..... 400/490; 200/345; 400/495

[58] Field of Search ..... 400/490, 491, 491.1, 400/491.2, 495, 495.1; 200/284, 292, 341, 345

[56] References Cited

U.S. PATENT DOCUMENTS

| | | | |
|---|---|---|---|
| 3,964,594 | 6/1976 | Gabbrielli et al. | 400/491 |
| 4,355,211 | 10/1982 | Steiner | 200/345 |
| 4,818,828 | 4/1989 | Curley et al. | 200/345 |
| 4,935,591 | 6/1990 | Kaneko | 200/341 |
| 4,997,998 | 3/1991 | Bauer | 200/345 |
| 5,172,990 | 12/1992 | Weng | 400/495 |
| 5,199,557 | 4/1993 | Brandt et al. | 200/345 |

*Primary Examiner*—Edgar S. Burr
*Assistant Examiner*—Lynn D. Hendrickson
*Attorney, Agent, or Firm*—Jacobson, Price, Holman & Stern

[57] ABSTRACT

Disclosed is a key switch including a key base fitted into a key hole on the frame of a keyboard body, two contact plates fastened inside the key base, a key cap covered on the key base, and a slide supported above a vertical stub tube inside the key base by a spring and having a bottom rod inserted in the bore of the stub tube, wherein the bore of the stub tube pierces through the bottom of the key base, and the bottom rod of the slide is maintained in flush with the bottom of the key base before it is being pressed; each contact plate has a contact leg extended out of the key base through a respective side hole and then bent downwards by 90° angle.

2 Claims, 4 Drawing Sheets

KEY SWITCH

BACKGROUND OF THE INVENTION

The present invention relates to key switches, and more particularly to a key switch for the keyboard of a mobile computer which minimizes the thickness of the keyboard.

A normal key switch for a computer keyboard, as illustrated in FIG. 1, is generally comprised of a key base 11, two contact plates 12,13, a spring 14, a slide 15, and a key cap 16. As illustrated in FIG. 2, the key base 11 is supported above the frame 17 of a keyboard body with its hollow center column 151 inserted in a hole on the frame 17; the contact plates 12,13 have contact pins 121 and 131 respectively inserted through a respective hole on the key base 11 into a respective hole 171 on the frame 17; the slide 15 is supported above the center column of the key base 11 by the spring 14, and has a bottom rod 151 inserted in the center column of the key base 11 and spaced from the inside bottom of the center column by a space A. The space A is provided for the movement of the bottom rod 151 of the slide 15. Because the key base 11 is mounted above the frame 17, much space in vertical direction is needed for moving the slide 15. Therefore, this structure of key switch requires much vertical installation space.

SUMMARY OF THE INVENTION

The present invention eliminates the aforesaid disadvantage. Therefore an object of the present invention is to provide a key switch with less vertical installation space. Another object of the present invention is to provide a key switch which can be inserted in a respective hole on the frame of a keyboard body during its installation, so that the thickness of the keyboard is therefore minimized.

According to the present invention, the key switch is comprised of a key, base fitted into a key hole on the frame of a keyboard body, two contact plates fastened inside the key base, a key cap covered on the key base, and depressible slide supported above a vertical stub tube inside the key base by a spring and having a bottom rod inserted in the bore of the stub tube. The bottom rod of the slide is maintained flush with the bottom of the key base before it is depressed, and can be moved downwards out of the key base to trigger an electric signal. Each contact plate has a contact leg extended exit of the key base through a respective side hole, and bent downwards by 90° angle, and then inserted through a respective hole on the frame and connected to a circuit. Because the key base is partly received inside the frame, the total thickness of the keyboard can be greatly minimized without reducing the range of the down stroke of the slide.

According to another feature of the present invention, the key base has rails and upward spring hooks for quick installation. When installed, the rails are stopped above the frame, and the upward spring hooks are hooked on the frame on the inside, and therefore the positioning of the key switch on the frame is stable.

DETAILED DESCRIPTION OF THE PREFERRED EMBODIMENT

Figure 1:
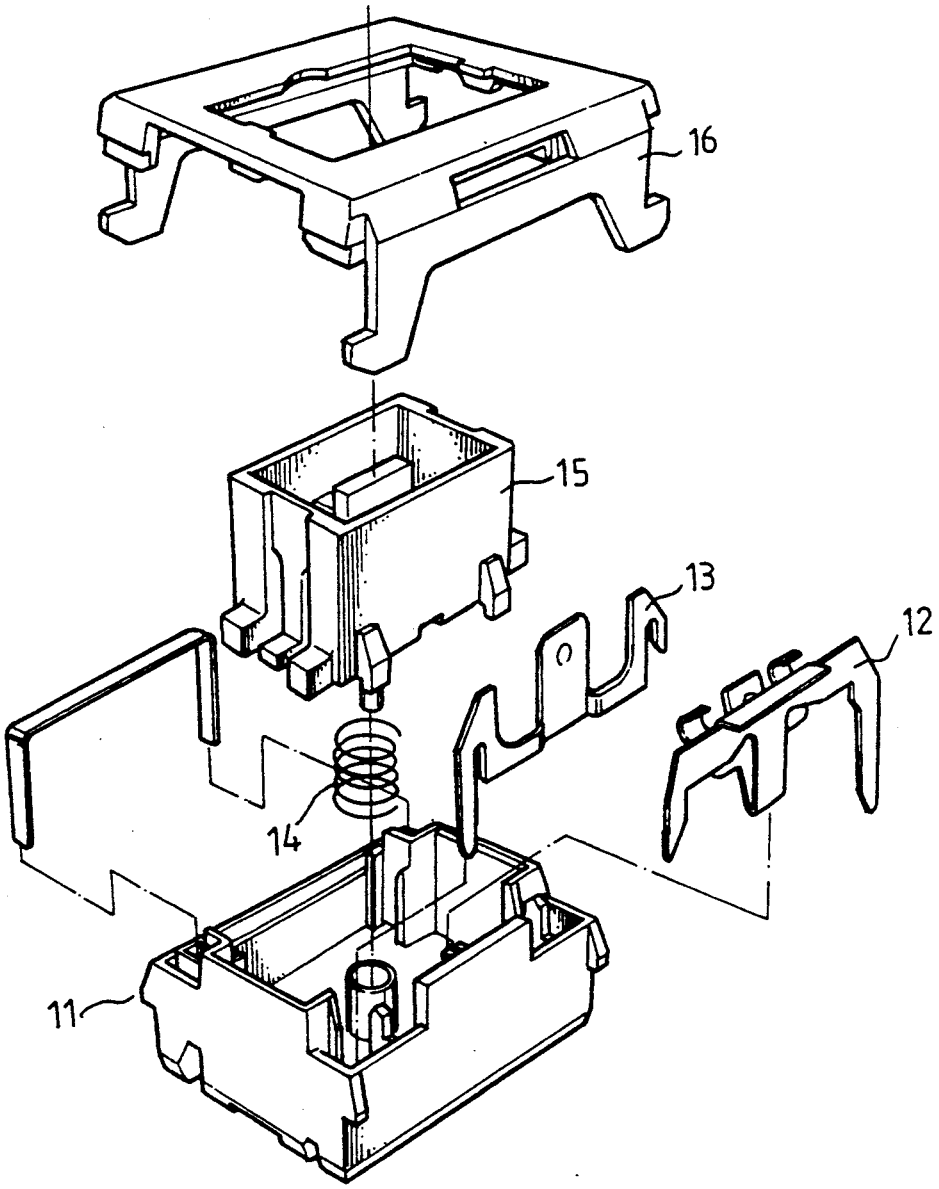
PRIOR ART FIG. 1
FIG. 1 is an exploded view of a key switch according to the prior art.
Figure 2:
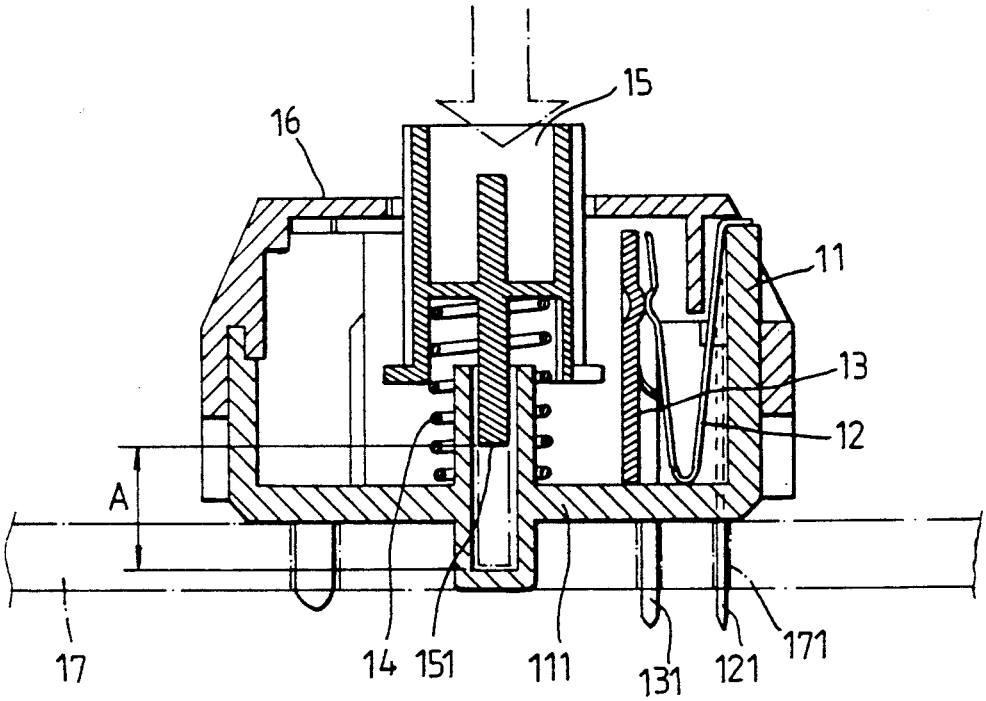
PRIOR ART FIG. 2
FIG. 2 is a sectional elevation of the key switch of FIG. 1.
Figure 3:
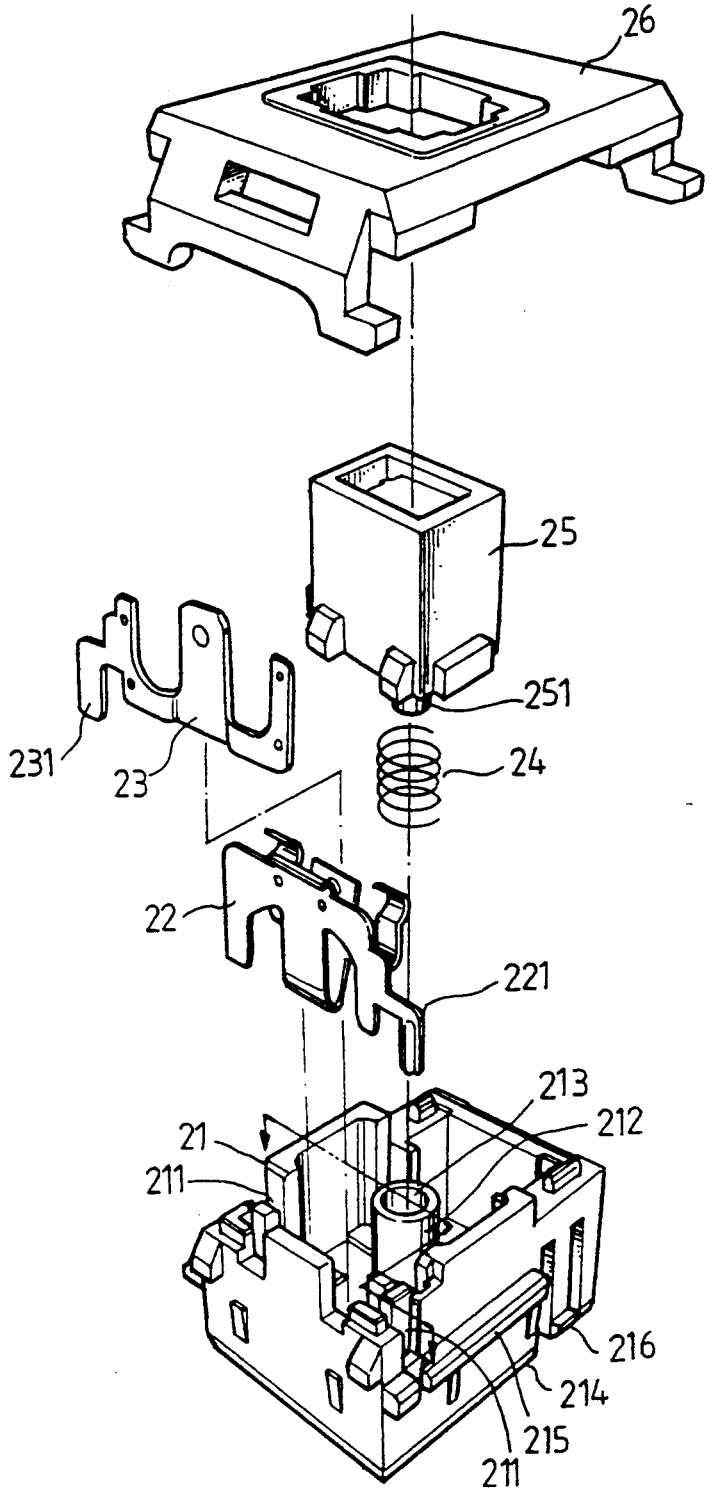
FIG. 3 is an exploded view of a key switch embodying the present invention.

Referring to FIG. 3, a key switch in accordance with the present invention is generally comprised of a hollow key base 21, two contact plates 22,23, a spring 24, a slide 25, and a key cap 26. The contact plates 22,23 are respectively inserted in the hollow key base 21 at two opposite locations with a respective leg 221 or 231 extended out of the hollow key base 21 through side holes 211 in reversed directions. The spring 24 is then mounted on a center stub tube 212 of the hollow key base 21, and then the slide 25 is supported on the spring 24 with a unitary bottom rod 251 thereof inserted into the center stub tube 212, and then the key cap 26 is covered over the slide 25 and fastened to the key base 21 through hooked joints. When assembled, the slide 25 protrudes over the key cap 26 (through a center hole thereon).

The stub tithe 212 of the key base 21 has a longitudinal center hole 213 through the bottom of the key base 21, and therefore the bottom edge of the bottom rod 251 of the slide 25 is normally maintained flush with the bottom surface 214 of the key base 21. The side holes 211 are made on two opposite side walls of the key, base 21 at a higher elevation. The leg 221 or 231 of the contact plate 22 or 23 bridges over either side hole 211 in horizontal direction and is then turned downwards by 90 angle.

Figure 4:
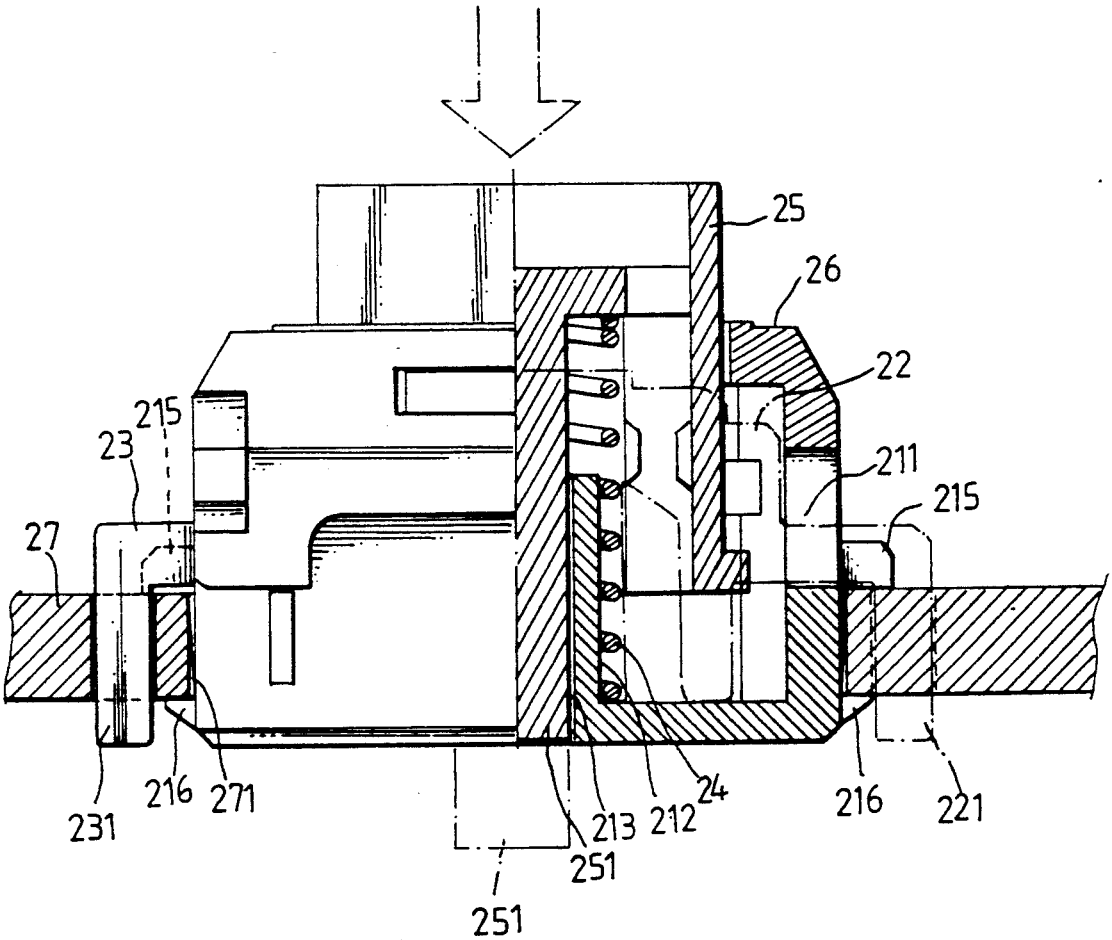
FIG. 4 is a sectional elevation of the key switch of FIG. 3 showing operation.

Referring to FIG. 4, pressing on the slide 25 causes the bottom rod 251 of the slide 25 to extend out of the bottom wall 214 of the key base 21 through the longitudinal center hole 213 of the stub tube 212 in triggering a circuit. Because no additional space is needed below the key base 21 for moving the slide 25, less vertical installation space is obtained. During the installation of the key switch, the key base 21 is inserted in a key hole (not specified) on the frame 27 of a keyboard body, and then the legs 221,231 are respectively inserted in holes 271 on the frame 27. This arrangement greatly reduces the thickness of the keyboard.

Referring to FIGS. 3 and 4 again, the key, base 21 has two horizontal rails 215 and upward spring hooks 216 on two opposite side walls thereof. As the key base 21 was inserted in a respective key hole on the frame 27, the rails 215 are respectively stopped against the top surface of the frame 27, and the spring hooks 216 are respectively hooked on the bottom surface of the frame 27. Therefore, the installation of the key switch is easy.

What is claimed is:

1. A key switch and keyboard in combination, said keyboard comprising a frame and a key hole, said key switch comprising a hollow key base having a bottom end fastened in said key hole, a center having a vertical stub tube located therein, said vertical stub tube having a bore;

two contact plates fastened inside said key base and located opposite each other, each contact plate having a leg extending out of said key base, respective side holes located on said key base through which said leg of each said contact plate extends;

a spring mounted on said vertical stub tube;

a key cap covered on said key base having hooks for securement thereto, said key cap having a hole thereon;

a depressible slide movably supported on said spring above said vertical stub tube, said slide having a top extended out of said key cap through said hole of said key cap, said slide having a bottom rod inserted in said bore of said vertical stub tube; and wherein said bore of said vertical stub tube pierces the bottom of said key base and said bottom rod of said slide is maintained flush with the bottom of said key base before being depressed; said leg of each contact plate extends through said respective side holes and having a bend of 90 degrees downward.

2. The key switch and keyboard combination of claim 1, wherein said key base comprises two opposite walls and two horizontal rails on said two opposite side walls thereof stopped above the frame of the keyboard, and two upward spring hooks on said two opposite side walls hooked inside the frame of the keyboard.

* * * * *